US005865665A

United States Patent [19]

Yueh

[11] Patent Number: 5,865,665

[45] Date of Patent: Feb. 2, 1999

[54] IN-SITU ENDPOINT CONTROL APPARATUS FOR SEMICONDUCTOR WAFER POLISHING PROCESS

[76] Inventor: William Yueh, P.O. Box 5874, Fullerton, Calif. 92838

[21] Appl. No.: 800,769

[22] Filed: Feb. 14, 1997

[51] Int. Cl.[6] ..... B24B 49/00; B24B 51/00

[52] U.S. Cl. ..... 451/5; 451/6; 451/7; 451/290; 451/285

[58] Field of Search ..... 451/6, 7, 5, 41, 451/285, 287, 288, 289, 10, 8, 53

[56] References Cited

U.S. PATENT DOCUMENTS

| | | | |
|---|---|---|---|
| 5,069,002 | 12/1991 | Sandhu et al. | 451/41 |
| 5,196,353 | 3/1993 | Sandhu et al. | 451/288 |
| 5,240,552 | 8/1993 | Yu et al. | 156/636 |
| 5,413,941 | 5/1995 | Koos et al. | 437/8 |
| 5,433,651 | 7/1995 | Lustig et al. | 451/6 |
| 5,597,442 | 1/1997 | Chen et al. | 451/7 |
| 5,643,050 | 7/1997 | Chen | 451/6 |
| 5,655,951 | 8/1997 | Meikle et al. | 451/41 |
| 5,658,183 | 8/1997 | Sandhu et al. | 451/6 |
| 5,659,492 | 8/1997 | Li et al. | 451/41 |

*Primary Examiner*—Timothy V. Eley
*Assistant Examiner*—Derris H. Banks
*Attorney, Agent, or Firm*—Herbert M. Shapiro

[57] ABSTRACT

Endpoint determination of a wafer removal process, in-situ, is afforded by the use of a Kalman filter known to be useful in celestial navigation. The use of line variable displacement transducers provides position error correction for the Kalman filter and the Preston equation provides the initial calibration for the endpoint determination. Accuracies of fifty angstrom are achieved.

11 Claims, 3 Drawing Sheets

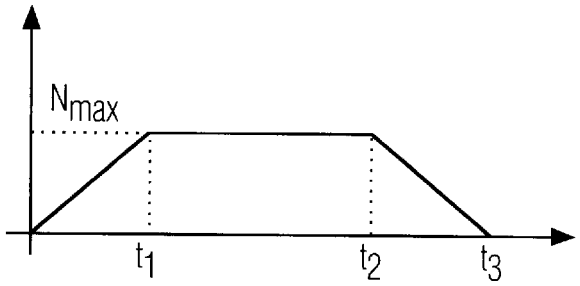
FIG. 1
| | LVDT NOISE BANDWIDTH (Hz) | LVDT 1-SIGMA NOISE LEVEL (MICRON) | ACHIEVED THICKNESS ESTIMATION ACCURACY (MICRON) | ACHIEVED REMOVAL RATE ESTIMATION ACCURACY (MICRON/MIN) |
|---|---|---|---|---|
| CASE 1 | 40 | 0.15 | 0.004 | 0.0045 |
| CASE 2 | 10 | 0.15 | 0.006 | 0.005 |
| CASE 3 | 40 | 0.30 | 0.006 | 0.005 |
FIG. 3
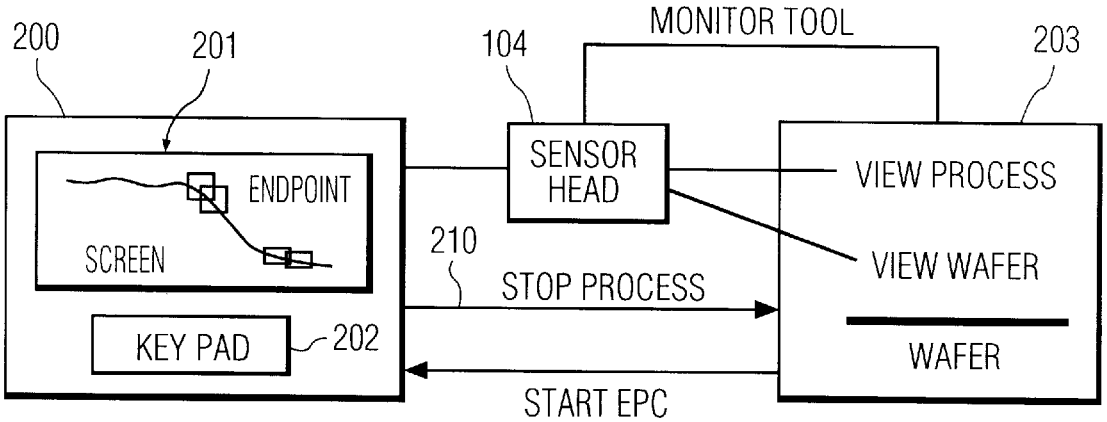
FIG. 5

100

IN-SITU ENDPOINT CONTROL APPARATUS FOR SEMICONDUCTOR WAFER POLISHING PROCESS

FIELD OF THE INVENTION

This invention relates to semiconductor wafer polishing processes and more particularly to apparatus for controlling the polishing process in real time by using a Kalman filter.

BACKGROUND OF THE INVENTION

The necessity for obtaining smooth and planar surfaces for the various layers in the production of multi-layer semiconductor wafers is well documented. Such layers are polished to the desired surface characteristics by a variety of different techniques. Chemical-mechanical polishing (CMP) is presently the technique of choice.

CMP employs a disk-shaped rotating platen, with a polishing pad, which rotates about an axis. In copending application serial numbers YUEH-1 filed Jan. 29, 1997 for the inventor of the present application, an annular-shaped platen with a non-rotating center core is disclosed. In either case, a wafer is secured to a sensor motor which rotates the wafer about its own axes and advances the wafer into contact with the pad. Thus, both the wafer and the platen are rotating and are in contact at a pressure determined by the actuator. The frequency at which the wafer rotates and the pressure on the wafer will be seen to be important parameters herein. A slurry is introduced between the wafer and the pad to aid in the polishing operation.

It is important to remove a sufficient amount of material to provide a smooth surface without removing an excessive amount of underlying materials. Consequently, it is important to monitor the removal rate or the wafer thickness variations and to ascertain when the end point of the polishing,, process has occurred.

There are many patents directed at techniques for determining that end point. U.S. Pat. No. 5,240,552, issued Aug. 31, 1993 describes an acoustic technique for determining such an end point. U.S. Pat. No. 5,413,941, issued May 9, 1995 describes a laser technique for determining the end point. U.S. Pat. No. 5,433,651 describes an optical technique using reflectance of light directed at the wafer through an aperture in the platen. All such techniques require sophisticated monitoring and control apparatus and achieve, at best, end point termination accuracy of about five hundred angstroms.

BRIEF DESCRIPTION OF THE INVENTION

In accordance with the principles of this invention, a Kalman filter employed for celestial navigation calculations is employed for the real time prediction of wafer material removal rates and thus wafer polishing process end points. A plurality of line variable displacement transducers (LVDT) are fixed to the table in which the platen of the polishing apparatus rotates and to the surface of the non-rotating center core of the apparatus to provide position error correction data for real time adjustment of the constant in the Kalman filter equations. End point determinations to an accuracy of fifty angstroms are achieved by such a technique, ten times better than any other technique now known.

BRIEF DESCRIPTION OF THE DRAWINGS

FIG. 1 is a graph of the normal force applied during wafer processing;

FIG. 3 is a chart of representative examples of removal rate estimations with a Kalman filter in accordance with the principles of this invention;

FIG. 5 is a block diagram of a process control system for stopping the wafer polishing process in accordance with the principles of this invention.

DETAILED DESCRIPTION OF AN ILLUSTRATIVE EMBODIMENT OF THIS INVENTION

Figure 2:
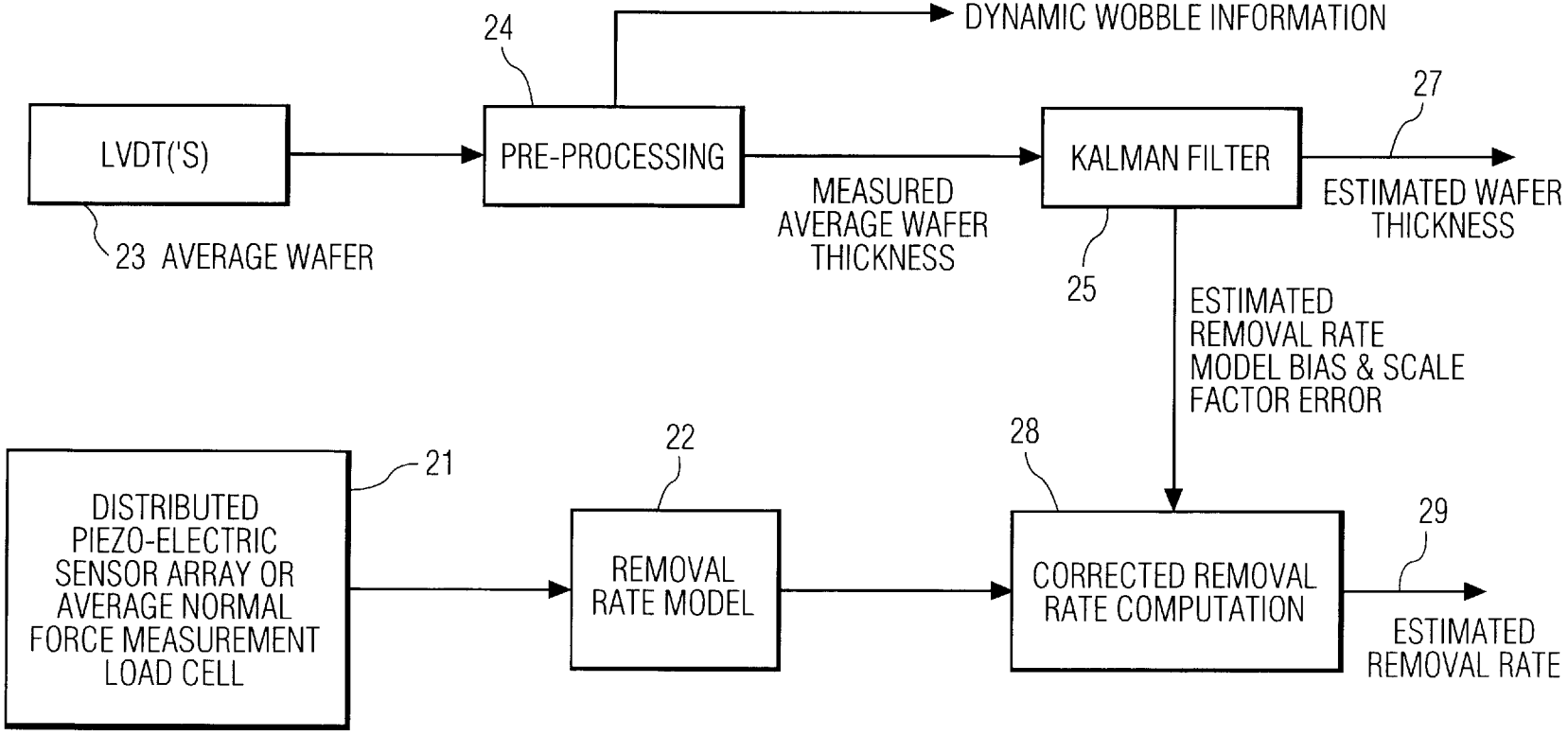
FIG. 2 is a block diagram of the system in accordance with the principles of this invention.

This invention employs a wafer removal rate prediction model using a Kalman filter. The model, in turn, employs the Preston equation and the normal force profile to obtain a very rough accuracy for the removal rate prediction reference point. The Kalman filter is adjusted on a real time basis with position error correction inputs from, illustratively, a plurality of LVDT (affixed to the polishing head) arrayed on a reference platform in the plane of which the polishing platen rotates. With an assumed error of twenty to thirty percent with the Preston coefficient providing system calibration, accuracies of better than 0.005 micron/minute is readily achieved with the Kalman filter.

The wafer removal rate during a CMP is described by Preston's equation:

$$\frac{dT}{dt} = K\frac{N}{A}\dot{s}$$

where N/A is the pressure introduced by the normal force A, S is the velocity of the particular point on the wafer of interest and K is the Preston coefficient which relates to the specific wafer properties and to the chemical reactions which occur during processing. In one embodiment where distributed piezoelectric sensors are present for measuring the pressure distribution, a point-by-point distributed model is used to model the removal process. In the absence of distributed sensors, the load cell, which provides the average pressure for the down force feedback information used in the Preston equation.

For CMP processing, the normal force, N, is roughly known, the wafer area is known and the average velocity can be computed from the angular velocity of the wafer and the platen. The applied normal force typically follows a profile shown in FIG. 1 which is described by the equations:

$$N = \begin{cases} \frac{t}{t_1} N_{max}, & 0 \leqq t < t_1 \\ N_{max}, & t_1 \leqq t < t_2 \\ \frac{(t - t_3)}{t_2 - t_3} N_{max}, & t_2 \leqq t < t_3 \end{cases}$$

The average speed is computed as:

$$\dot{s}_{arg} = \frac{1}{\pi r_0^2}\int_0^{r_0}\int_0^{2\pi} R_0\Omega_p\left(1+\frac{1}{2}\left(\left(\frac{r\Omega_w}{R_0\Omega_p}\right)^2 - 2\frac{r\Omega_w\cos 0}{R_0\Omega_p}\right)\right) r d0 dr$$

$$= \frac{2}{r_0^2}\int_0^{r_0} R_0\Omega_p\left(1+\frac{1}{2}\left(\frac{r\Omega_w}{R_0\Omega_p}\right)^2\right) r dr$$

$$= R_0\Omega_p\left(1+\frac{1}{4}\left(\frac{r_0\Omega_w}{R_0\Omega_p}\right)^2\right)$$

By combining the normal force and the average speed we obtain:

$$R \equiv \left(\frac{dT}{dt}\right)_{avg} = K\frac{N}{A}\, s_{avg} = K\frac{N}{A}\, R_0\Omega_p\left(1+\frac{1}{4}\left(\frac{r_0\Omega_w}{R_0\Omega_p}\right)^2\right)$$

Where the constant K needs to be calibrated for each batch of (pattern) wafers and provides a reference model with accuracy improvements provided by the Kalman filter. It is noted that all the variables except N are constant. Thus, K can be measured, for example, by measuring wafer thickness before and after the polishing process.

The Kalman filter is constructed from the following equations:

$$\hat{T}(k+l|k)=\hat{T}(k)+R^m(k)\Delta T \quad \hat{T}(k+l)=\hat{T}(k+l|k)+K(k)(T^m(k+l)-\hat{T}(k+l|k)$$

Where the time varying gain K(k) and the variance of the estimate variance of the estimate $\hat{T}$, $\hat{P}$ are given by the equations:

$$K(k) = \frac{P(k)+q_R(k)}{P(k)+q_R(k)+q_T(k)}$$

$$P(k+1) = \frac{P(k)+q_R(k)}{P(k)+q_R(k)+q_T(k)}\, q_T(k$$

Operating tinder the assumption that the variance of the position measurement noises are constant, we arrive at a Kalman filter which converges to a steady state wafer thickness measurement which satisfies the following equation:

$$P = \frac{P+q_R}{P+q_R+q_T}\, q_T$$

Which has the following solution:

$$P = \frac{1}{2}(q_T+q_R)\left(\sqrt{1+\frac{4q_Tq_R}{(q_T+q_R)^2}}-1\right) \approx \frac{q_Tq_R}{q_T+q_R}$$

This Kalman filter provides an approximate simple result which is very meaningful and can be used to perform simple and straightforward performance analyses. For an example of such an analysis for, say, a performance requirement of at least 0.01 micron wafer thickness estimation accuracy and 0.15 micron LVDT accuracy, we have $$\frac{0.15q_R}{0.15+q_R} = 0.01^2$$

$$q_R = 0.15/14 \approx 0.001^2 \text{ (micron}^2\text{)}$$

or Assuming 20 Hz data measurement and processing rate, the equivalent wafer removal rate measurement accuracy needs to be better than $$\frac{0.01 \text{ (micron)}}{1/20 \text{ (seconds)}} = 2 \text{ micron/sec} = 120 \text{ micron/min}$$

Since the wafer removal rate is normally very low, the above number virtually states that even if the assumed removal rate were zero, the wafer thickness estimate, as the output of the Kalman filter still is very accurate.

FIG. 2 shows a block diagram of the wafer removal rate system in accordance with the principles of this invention. The figure shows block 21 indicating the wafer removal process empirical model, the output of which provides input to the rough removal rate model represented by block. Block 23 represents the LVDT array, the output of which provides the preprocessing position error correction data for the Kalman filter as represented by blocks 24 and 25 respectively. The output of the LVDT's also provides the dynamic wobble information as indicated in the figure. The (position error corrected) output of the Kalman filter provides the (instantaneous) estimated wafer thickness and the corrected removal rate computation as indicated by arrow 27 and block 28. The corrected removal rate computation provides the estimated removal rate as indicated by arrow 29.

In one specific example of the wafer removal rate determination using a Kalman filter and position error correction from an array of three LVDT's, the normal force profile of FIG. 1 is used and the parameters are as follows: $t_1$=30 sec; $t_2$=150 sec; $t_3$=180 sec; $N_{max}$=300 lbs; $A=\pi t^2=16\pi=50.26$ inch$^2$ $N_{max}/A=30/50.26=5.97$ lbs/inch-$^2$ assuming that a test sample indicated a 0.3 micron/minute average removal rate in a three minute test, DTC 0.9 micron. The integrated normal force over a three minute time interval is estimated to be $$\int_0^{t_1} N dt = \frac{N_{max}}{2}(t_3+t_2-t_1) = (300/2)*(150+180-30) = 45000$$

The overall scale factor contains the rotation rate, area and other information such that $$\Delta T = C\int_0^{t_1} N dt$$

FIG. 3 is a table of three simulation cases using the Kalman filters with LVDT transducers. As can be seen in the figure, case 1 had a LVDT noise bandwidth of 40 Hz; an LVDT 1-sigma noise level of 0.15 micram, achieved a thickness estimation accuracy of 40 angstrom and a removal rate estimation of 4.5 nm/min. Similar numbers for case 2 were 10 Hz, 0.15 micron, 60 angstrom and 5.0 nm/mim. In case 3, the numbers were 40 Hz, 0.30 micron, 60 angstrom, and 5.0 nm/min.

Figure 4:
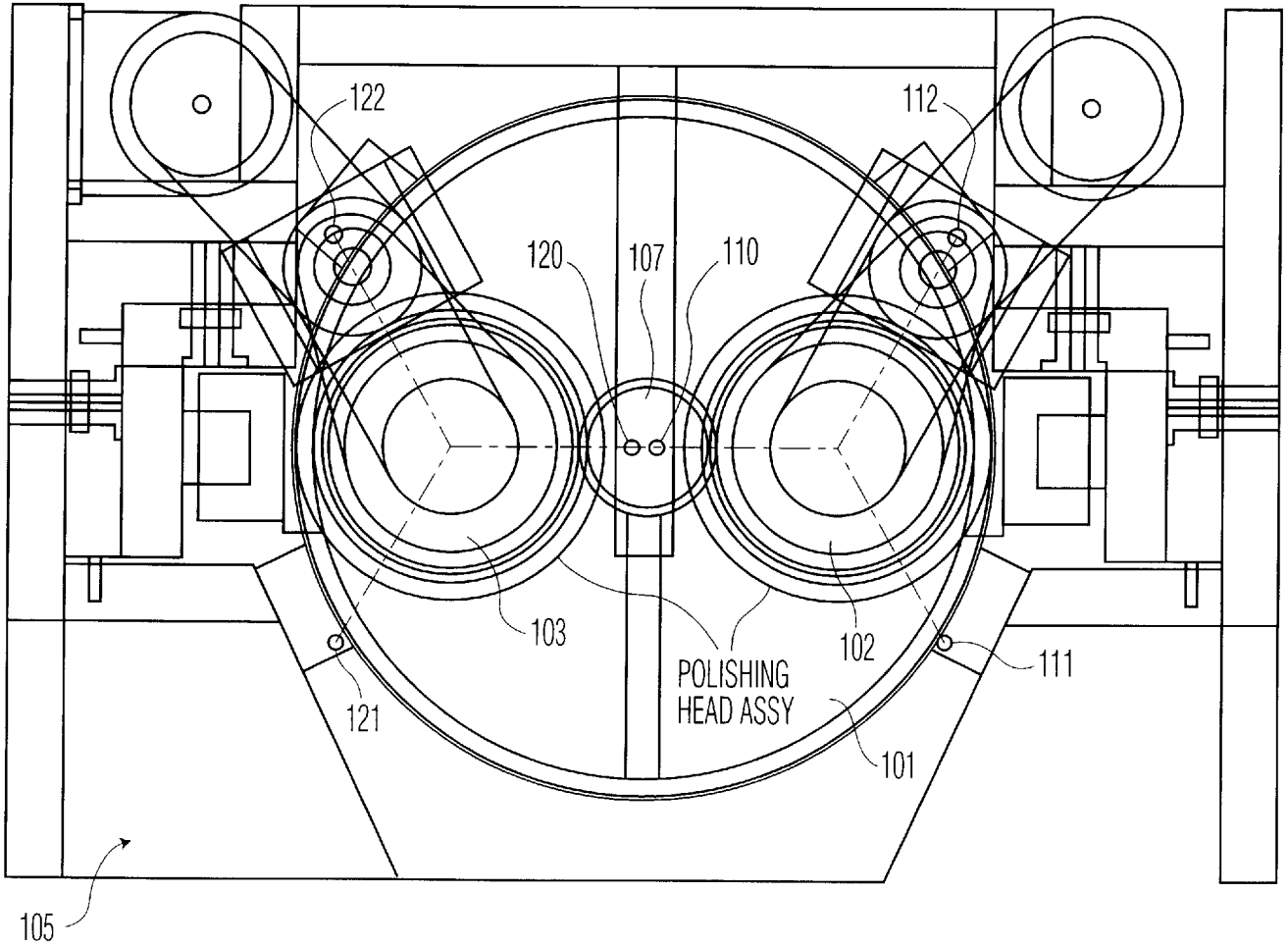
FIG. 4 is a top view of a CMP polishing apparatus showing the positions of the LVDT devices with respect to the polishing heads.

FIG. 4 is a top view of a CMP wafer polishing apparatus 100 with a platen 101 and a polishing head assembly with two polishing heads 102 and 103. The platen rotates in the plane of the top surface 105 of the table which surrounds the platen. The polishing apparatus includes a non-rotating center core 107. The arrangement includes three LVDT devices 110, 111, and 112 for polishing head 102 and 120, 121, and 122 for polishing head 103. LVDT devices with the specified accuracy are available commercially from Omega Engineering Inc. of Stamford, Conn.

The outputs of the LVDT devices are processed as indicated by block 24 of FIG. 2 to provide position error correction as to wafer thickness as inputs to the Kalman filter indicated by block 25 of FIG. 2.

The use of a Kalman filter in celestial navigation is disclosed in U.S. Pat. No. 4,783,744 issued Nov. 8, 1988 to the present inventor.

FIG. 5 shows a block diagram of the wafer process controller responsive to output of the Kalman filter of FIG. 2. Specifically, FIG. 5 shows an end point controller 200 which may comprise a computer having a screen 201 and a keypad 202. The system also includes the wafer polishing apparatus or processing tool 203. The system also includes a sensor head (LVDT's) 104 which performs as a monitoring head for the process and the wafer. The Preston equation provides the initial calibration, the Kalman filter provides a real time prediction model and the LVDT's provide real time position error correction to the Kalman filter. Thus, the process provides an end point signal when the output of the Kalman filter (25 of FIG. 2) resides within the one-sigma bound of the estimate.

A detailed analysis and simulation results for Kalman filter based, real time wafer thickness and removal rate estimator for chemical-mechanical polishing (CMP) is provided in the following appendix: The analysis employs a normal force profile to provide the rough rate estimation rather than the use of piezoelectric sensors to provide the estimation.

Angstrom level accuracy for patterned wafers, wafer thickness estimation error of 50 angstrom (pattern or blanket wafer), and 30 times noise reduction from LVDT raw data can be achieved using a Kalman filter as disclosed herein. Such a high degree of control provides, for example, valve control for slurry collection and recycling and for pad in-situ reconditioning.

What is claimed is:

1. An apparatus for polishing a wafer and for providing an indication when the endpoint of the polishing process occurs, said apparatus comprising a pad-covered platen and means for rotating said platen in a plane about a first axis normal to that plane, said apparatus including a wafer holder and means for rotating said holder about a second axis also normal to said plane, controller means for juxtaposing said wafer holder against said platen, and for controlling the movement of said wafer bolder with respect to said platen, said controller including a Kalman filter for providing a real time prediction of the wafer removal rate of said process per unit time, said apparatus also including means for determining the real time wafer thickness variation for providing error correction data to said controller for correcting the output of said Kalman filter, said controller also including an empirical model for providing an end of process indication when the output of said Kalman filter equals the output of said empirical model.

2. Apparatus as in claim 1 wherein said empirical model comprises the Preston equation with the Preston coefficient determined empirically.

3. Apparatus as in claim 1 wherein said monitoring means comprises an array of line variable displacement transducers (LVDT's) in said plane.

4. Apparatus as in claim 1 wherein said platen has an annular configuration and rotates about a non-rotating center core in a plane defined by the top surface of a rigid table, said LVDT's being arranged on said top surface and on said center core.

5. Apparatus as in claim 1 wherein said process comprises a chemical-mechanical polishing process and said apparatus includes means for introducing a slurry onto said platen.

6. Apparatus for controlling the pressure and the relative movement of a wafer holder with respect to a pad-covered platen against which the holder is urged during a wafer removal process, said apparatus comprising a controller including a Kalman filter and position error correction means, said position error correction means comprising wafer removal monitoring means for providing data indicating the actual rate of wafer thickness variation per unit time to said Kalman filter, said controller including an empirical model for providing an end-of-process indication, said controller being responsive to a match between an output from said Kalman filter and said end-of-process indication for terminating said process.

7. Apparatus as in claim 6 wherein said truth model comprises the Preston equation.

8. An in-situ CMP process endpoint prediction and control apparatus for terminating CMP polishing process, said apparatus including a platen and means for rotating said platen in a plane about an axis normal to said plane, a wafer holder for juxtaposing said wafer against said platen for material removal therefrom, said apparatus including wafer thickness measuring devices for sensing the thickness of a wafer being polished, said apparatus also including a Kalman filter responsive to outputs from said devices for providing position error correction information and to Preston equation calibration calculations for stopping said process.

9. A method for monitoring and ini-situ chemical-mechanical polishing process for planarization of a wafer, said method comprising the steps of deriving a rough estimate of the wafer removal rate, providing real time position error correction of the thickness of a wafer being polished and being a Kalman filter calibrated to said rough estimate and adjusted by said real time position error correction for determining said process end point.

10. A method as in claim 9 wherein said rough estimate is derived from a normal force profile.

11. A method as in claim 10 wherein said real time position error correction is provided by an array of line variable displacement tranducers.

* * * * *